US006012387A

United States Patent [19]

Hoffman, Jr. et al.

[11] Patent Number: 6,012,387

[45] **Date of Patent: *Jan. 11, 2000**

[54] MOBILE SCREEN PRINTING SYSTEM

[75] Inventors: Richard C. Hoffman, Jr., St. Charles; Dariusz Tkacz, Naperville, both of Ill.; Thadius Hutton, Carlsbad, Calif.

[73] Assignee: M&R Printing Equipment, Inc., Glen Ellyn, Ill.

[ * ] Notice: This patent is subject to a terminal disclaimer.

[21] Appl. No.: 09/151,859

[22] Filed: Sep. 11, 1998

Related U.S. Application Data

[63] Continuation-in-part of application No. 08/890,015, Jul. 10, 1997, Pat. No. 5,881,641.

[51] Int. Cl.[7] ..... B41F 15/14

[52] U.S. Cl. ..... 101/115; 101/126; 101/127.1

[58] Field of Search ..... 101/114, 115, 101/126, 127.1

[56] References Cited

U.S. PATENT DOCUMENTS

| | | | |
|---|---|---|---|
| 5,129,155 | 7/1992 | Hoffman et al. | 33/614 |
| 5,195,434 | 3/1993 | Hoffman | 101/126 |
| 5,383,400 | 1/1995 | Szyszko | 101/126 |
| 5,595,113 | 1/1997 | Daniel et al. | 101/115 |

OTHER PUBLICATIONS

"10–Color Capability Servo–Driven Indexer User–Friendly Controls" Gauntlet Series II advertising brochure.

"Challenger Textile Screen Printing System" advertising brochure

*Primary Examiner*—Christopher A. Bennett

*Attorney, Agent, or Firm*—Wallenstein & Wagner, Ltd.

[57] ABSTRACT

A mobile printing shop (300,301,302) is disclosed including a turret style printing machine (10) having a plurality of folding radial arms (30,70,170) and a vehicle (300, 301, 302) for transporting the machine (10).

14 Claims, 11 Drawing Sheets

MOBILE SCREEN PRINTING SYSTEM

RELATED APPLICATION

This application is a continuation in part application of U.S. patent application Ser. No. 08/890,015, filed Jul. 10, 1997, titled Hinged Arm Assemblies For Screen Printing Machine System, now U.S. Pat. No. 5,881,641.

DESCRIPTION

1. Technical Field

The present invention relates generally to printing machines and, more particularly, to a mobile printing machine shop including a vehicle and a turret or carrousel style foldable arm screen printing machine.

2. Background Prior Art

Indicia applied permanently to articles of clothing and other textiles have become very popular. Fanciful indicia, such as logos, slogans, college names, sports team names and sayings, are now commonplace. As a result, screen printing has become very popular. Large, commercial operations screen printing textiles are common today.

Indicia can be one or more colors. Typically, a screen printing machine has at least one station for each color employed. For example, a design incorporating two colors will have at least two printing stations, one for each color. A design employing eight colors will have at least eight stations. Each station generally includes a printing head, which supports a single screen, the ink to be used at that station and a mechanism for applying the ink to the textile. Each color is carried by a single screen. The textile to be screened travels from printing station to printing station by one of a number of methods, such as a chain or a rigid arm. The textile is usually carried by a metal pallet, pallet support, flat bed, or platen. Common printing machines include turret, oval and linear. In addition to printing stations, there may also be curing stations to heat and set the inks placed on the textile or substrate.

In both the linear and oval style printing machines, the pallet carrying the textile to be printed upon travels via a chain on a track or rail from station to station. In the turret or carrousel style printing machine, a center section has a plurality of spider arms. Generally, there are two levels of spider arms, namely, an upper level carrying the printing heads and screens or the curing assemblies, and a lower level carrying the pallet with the textile to be printed upon. Either the lower pallet/textile arms rotate with respect to the printing/curing arms or the printing/curing arms rotate relative to the pallet/textile arms. The stationary arms are commonly referred to as "stations."

The traveling arm moves from station to station. Specifically, each moving arm is indexed and registered at a station, the station's function, be it printing or curing, performed and the arm moves to the next station.

For clarity, the discussion following will focus on one configuration, that being stationary upper arms supporting printing heads or curing units, with the lower arms supporting the pallets and textiles traveling. It is appreciated this configuration can be different, e.g., stationary pallet/textile stations and traveling printing/curing arms. The teachings of this disclosure work well in any of the configurations.

One highly successful machine of the type just noted is manufactured and sold by M&R PRINTING EQUIPMENT, INC. ("M&R"), Glen Ellyn, Ill. as the GAUNTLET™ Series Automatic Textile Printing Machines. Patented innovations include, among other things, an AUTOMATIC SCREEN REGISTRATION DEVICE AND METHOD THEREFOR, U.S. Pat. No. 5,129,155; an ARTICLE DETECTOR FOR PRINTING PRESS, U.S. Pat. No. 5,383,400; and a SEQUENCING SYSTEM FOR PRINTING MACHINE, U.S. Pat. No. 5,595,113.

The present innovation may also be employed in other machines, such as M&R's CHALLENGER® Series Automatic Textile Printing Machines.

Unfortunately, one drawback of this and other similar machines is the size, resulting in the lack of mobility of such machines. For example, the diameter across the assembled machine is generally between 12 and 14 feet, depending on the number of stations. This is also the minimum required floor space necessary to store and transport an assembled machine. As a result, such machines are rarely transported, except to the customer from the manufacturer and from one owner to a subsequent owner or lessee in a later sale or lease. One method of freeing floor space and reducing transporting size of the machine is to disassemble and reassemble the machine each time the machine is either stored and in non-use or transported. This can be both time-consuming and costly. Another technique is folding the machine to a smaller diameter. However, this, too, can be difficult as the machine is both heavy and incorporates significant structural components, as well as very fine, precise components. In a companion application titled HINGED ARM ASSEMBLIES FOR SCREEN PRINTING MACHINE SYSTEM, filed Jul. 10, 1997, Ser. No. 08/890,015 (Attorney Docket No. 1199 P 116), the advancement disclosed is a redesign of the machine to permit ease of folding and unfolding, without affecting the strength of the machine, the operation of the machine, and the precise tuning of the machine. The present invention is a further development of this concept, a portable screen printing shop. This shop includes a truck for holding, storing and transporting the foldable printing machine, hardware associated therewith and shop components necessary for mobile production of screen printed wares.

SUMMARY OF THE INVENTION

According to the present invention, an apparatus and method are disclosed for folding a turret style printing machine. The machine has a plurality of radial arms, each movable between a first, extended position for operating the machine and a second, folded position for storing or transporting the machine. The radial arms include both upper arms and lower arms. Each arm is connected proximate one end to a base section with the lower arms, supporting pallets and the items to be printed upon, moving relative to the stations, that being the upper arms supporting a printing head or conventional curing unit. In the extended position for operation, the arms of the machine have a first overall machine diameter and in the folded mode, the arms of the machine having a second overall machine diameter, the first overall diameter being greater than the second overall diameter.

A hinge assembly is disposed between the ends of the arms for folding each arm by moving the other end of each arm generally towards the base section. In particular, the upper arms are staggered between the lower arms and the lower arms are folded upwardly and the upper arms are folded downwardly. Each arm further includes means for locking the extended arm and either locking or maintaining the folded arm.

Registration means are provided for ensuring registration of each arm in the first, extended position. The registration means includes at least one projecting post connected to one arm section and one indent means associated with the other of the arm section for receiving and capturing the post when the arm is in the first, extend position.

Each arm has a first arm section connected to the base section and a second arm section supporting the printing head (or curing unit) or the pallet. The first arm section has a first mating portion and the second arm section has a second mating portion; the hinge assembly cooperates with the first and second mating portions. The hinge assembly includes means for permitting rotation of the second mating portion relative to the first mating portion.

Both the first and second pins are locking pins moveable between an unlocked position wherein the other of the mating portions is movable relative to the parallel plates and a locked position wherein the other of the mating portions is secured to the plates.

The present invention is a further development of this concept, a portable screen printing shop. This shop includes a truck for holding, storing and transporting the foldable printing machine, hardware associated therewith and shop components necessary for mobile production of screen printed wares.

In most instances, a printing machine is manufactured and completely or partially disassembled for transporting to its final destination. At this destination, the machine is removed from the item transporting it, e.g., truck, and assembled at the new location, such as a print shop. Here, the machine is transported in an assembled state and actually set up in a single vehicle. As a result, the vehicle is the print shop. This mobile print shop permits the printing machine to travel to various activities and functions (fairs, block parties, concerts, sporting events, etc.) for on-site printing and distribution of wares.

The vehicle stores the assembled, but folded, machine. The truck has four walls for holding the cargo (machine). To accommodate the machine in its expanded position and its operating mode (extended position), the truck includes two side panels, with each of the side panels opening up to permit the machine to be unfolded to the operating size with the arms fully extended. In addition, the vehicle has at least one foldable side platform for increasing the vehicle's floor space. This further permits the operator(s) to work at all points around the machine. Additionally, people at the machine's site purchasing printed wares can file past the machine.

In addition to the vehicle storing the assembled, but folded, machine, it also stores other important equipment for printing textiles. Such equipment includes means for preparing the printing screens, means for storing the textiles, and means for drying the printed upon textiles.

Other advantages and aspects of the present invention will become apparent upon reading the following description of the drawings and the detailed description of the invention.

BRIEF DESCRIPTION OF DRAWINGS

To understand the present invention, it will now be described by way of example, with reference to the accompanying drawings in which.

DETAILED DESCRIPTION

Figure 1:
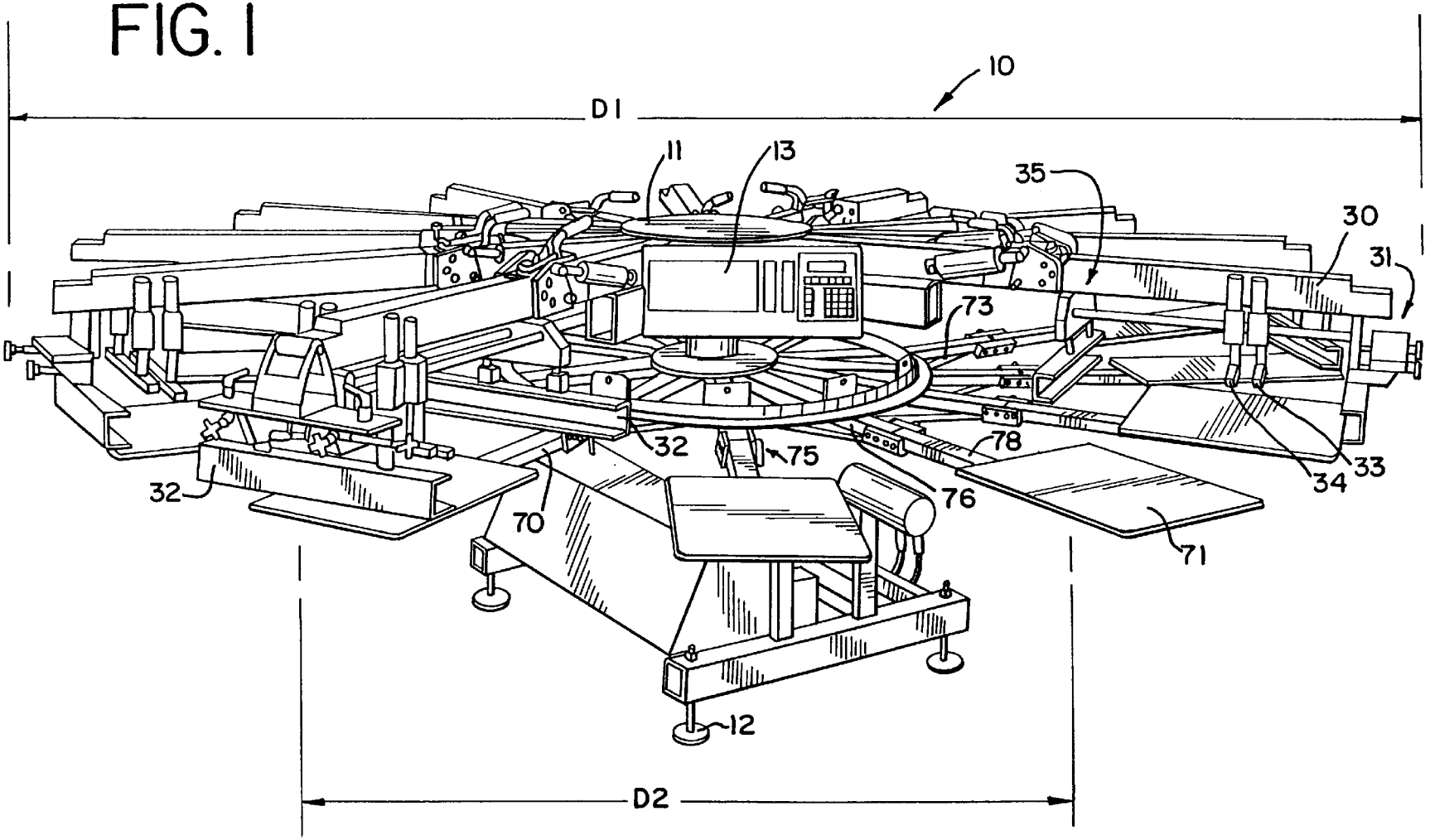
FIG. 1 is a front perspective view of the assembly with the spider arms in the extended, operational position.

While this invention is susceptible of embodiment in many different forms, there is shown in the drawings and will herein be described in detail preferred embodiments of the invention with the understanding the present disclosure is to be considered as an exemplification of the principles of the invention and is not intended to limit the broad aspects of the invention to the embodiments illustrated.

The Overall Machine 10

Referring to the Figures, a typical turret style printing press 10 is shown consisting of a central turret or base section 11 supporting a plurality of spaced apart, spoking, radial upper arms 30 and radial lower arms 70. In the embodiment shown, the distal ends of the lower arms 70 support metal pallets, flat beds, or platens 71 for carrying the textile or substrate (not shown) to be printed upon. The distal ends of the upper arms 30 support printing heads 31 or conventional, well-known curing units (not shown). While the machine of the present invention is shown and described having upper arms supporting printing heads or curing units and the lower arms supporting pallets, it is, of course possible for the upper arms to support the pallets and the lower arms to support the printing heads or curing units.

One of the sets of arms 30,70 rotates around the base section 11. In the embodiment shown, the lower arms 70 rotate relative to the upper arms 30. This base section 11 includes, among other things, the unit's 10 supporting feet 12 and control panel 13.

The typical printing head includes a screen (not shown) supported by opposed arms 32. A flood bar 33 brings paint to the screen wherein it is applied across the screen by a squeegee 34. Together, a print is formed on the textile.

These printing heads, or curing units, form stations. Ten (10) such stations are shown in FIG. 1. The pallet 71 with the textile thereon is rotated, indexed and registered at each station where the textile is worked on, that being either printed upon or cured. Each arm 70 and pallet 71 rotates through the ten stations. While it is appreciated the upper arms can rotate relative to the lower arms or the pallets and printing heads can be reversed, the present invention will be discussed with the stationary printing heads attached to the upper arms and the rotating pallets attached to the lower arms.

Figure 1A:
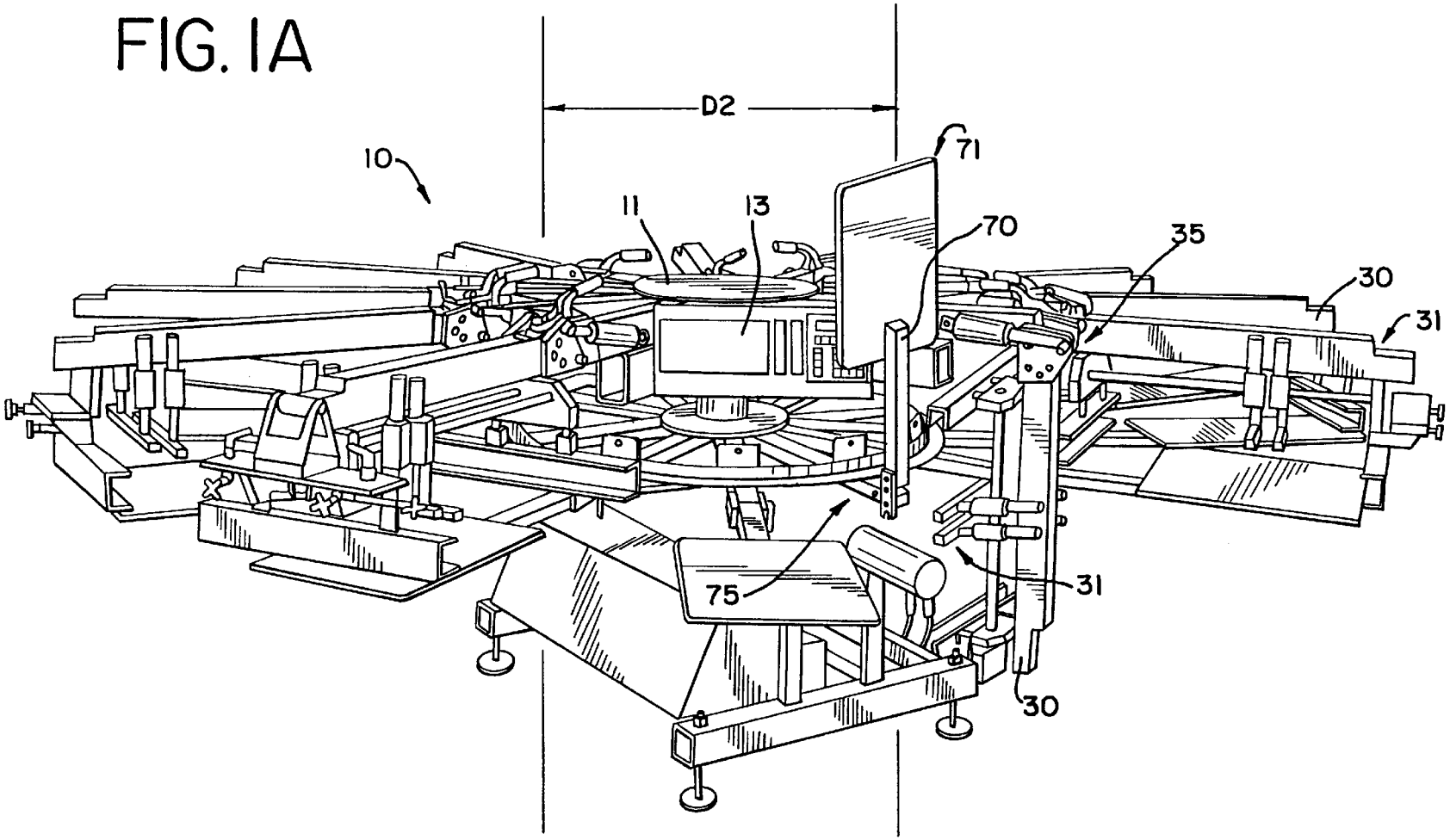
FIG. 1A is a front perspective view of the assembly with two spider arms in the folded, storing/transporting position.

In FIG. 1, the arms 30,70 are shown in their extended and operating position. They are all locked outwardly or in their extended positions. FIG. 1A shows two arms in a second position, namely, a folded position, for either storing or transporting the entire machine 10.

To transform the machine 10 from its operation state to its storage/transport state, each arm is folded. In particular, the lower arms 70 are rotated such that the upper arms 30 are disposed between the lower arms. See FIG. 1A. The upper and lower arms are thus not aligned; they are staggered. The upper arms 30 are then folded down and the lower arms 70 are folded up. In the folded positions, the printing heads 31 of the upper arms 30 are situated generally between the base section 11 and the arms' 30 extended positions and the pallets 71 of the lower arms 70 are situated generally between the base section 11 and the arms' 70 extended positions.

Figure 20:
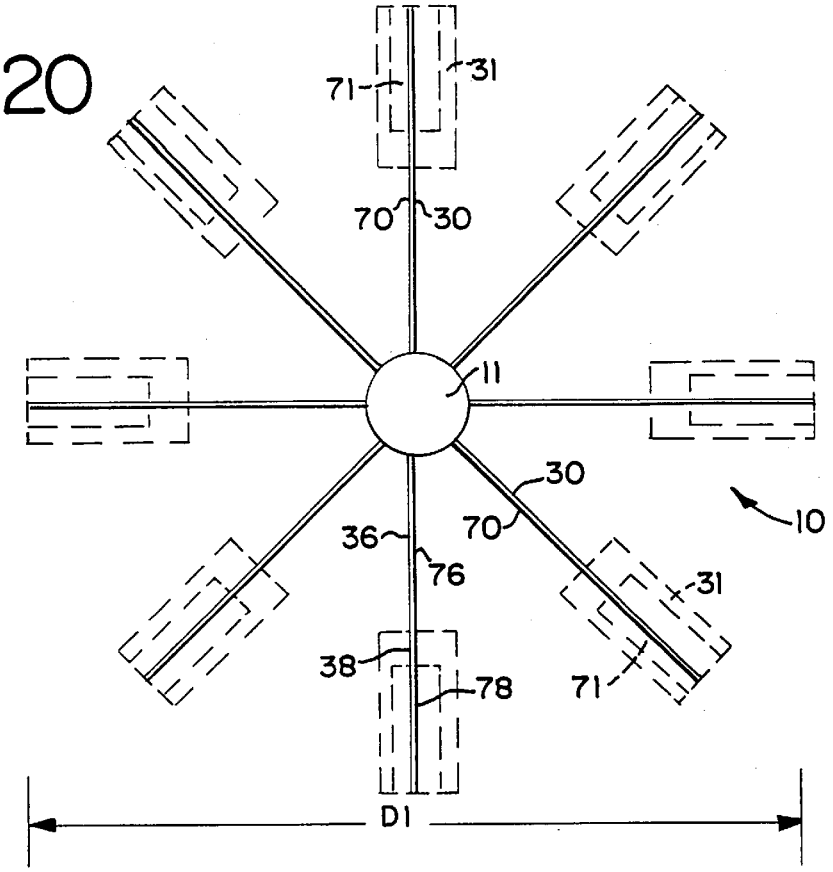
FIG. 20 is a schematic drawing showing the assembly in the extended first position.
Figure 21:
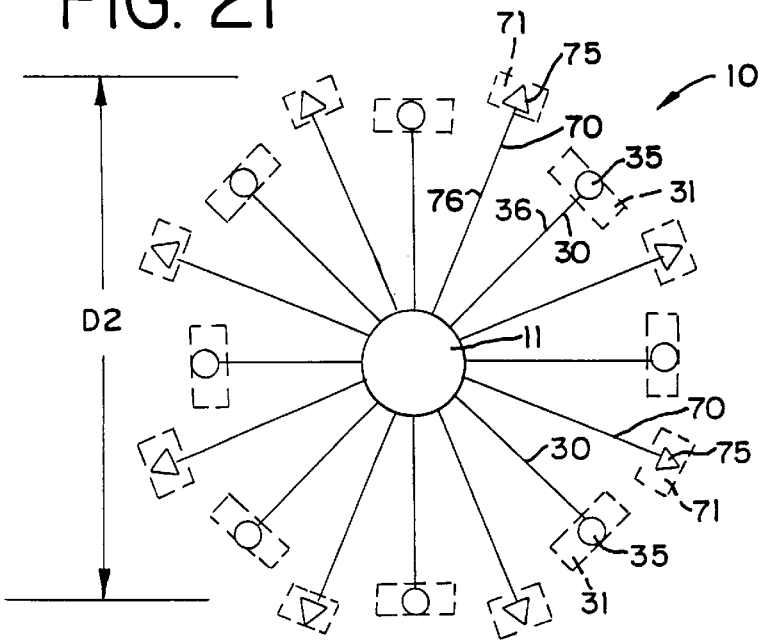
FIG. 21 is a schematic drawing showing the assembly in the folded second position.

In short, as shown schematically in FIGS. 20 and 21, the entire machine 10, having an overall diameter (D1)(FIGS. 1 and 20) of about 12 to 14 feet overall machine diameter when the machine is in operation, can be folded to have an overall diameter (D2)(FIGS. 1, 1A and 21) of about 7½ feet folded for transporting the machine around a facility or in a truck or for storage in the same location or in another, nearby location. To accomplish this maneuver, there are means disposed between the ends of the arms for folding each of the arms from its extended (first) position to its folded (second) position, that being closer to the base section. The means are generally hinge assemblies 35,75,175 attached to the arms 30,70,170.

The Upper Arms 30

Figure 3:
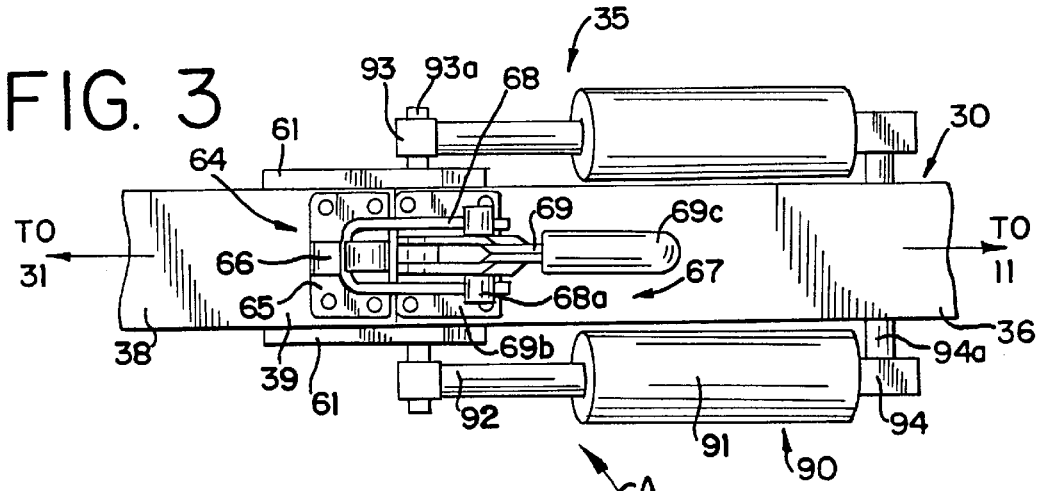
FIG. 3 is a top plan view of the upper arm and hinge assembly of FIG. 2.
Figure 2:
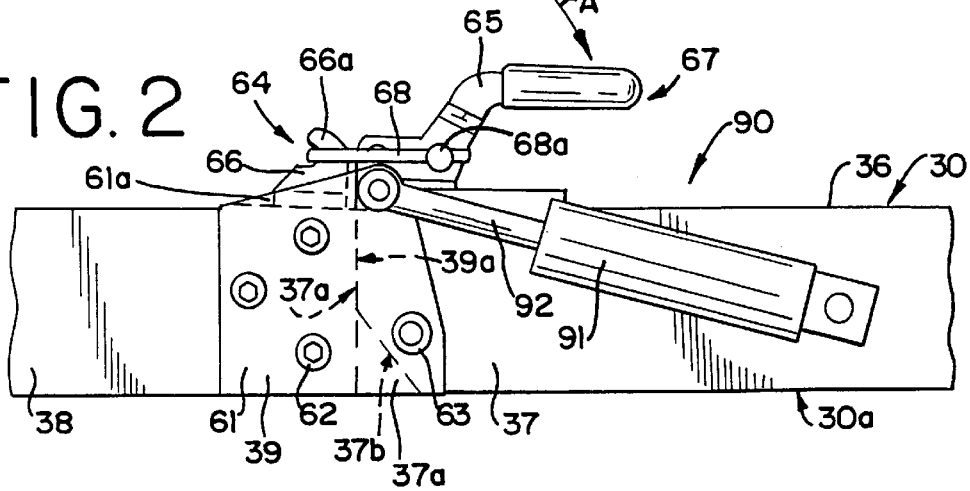
FIG. 2 is a side elevation view of an upper arm and hinge assembly in the first extended position.
Figure 4:
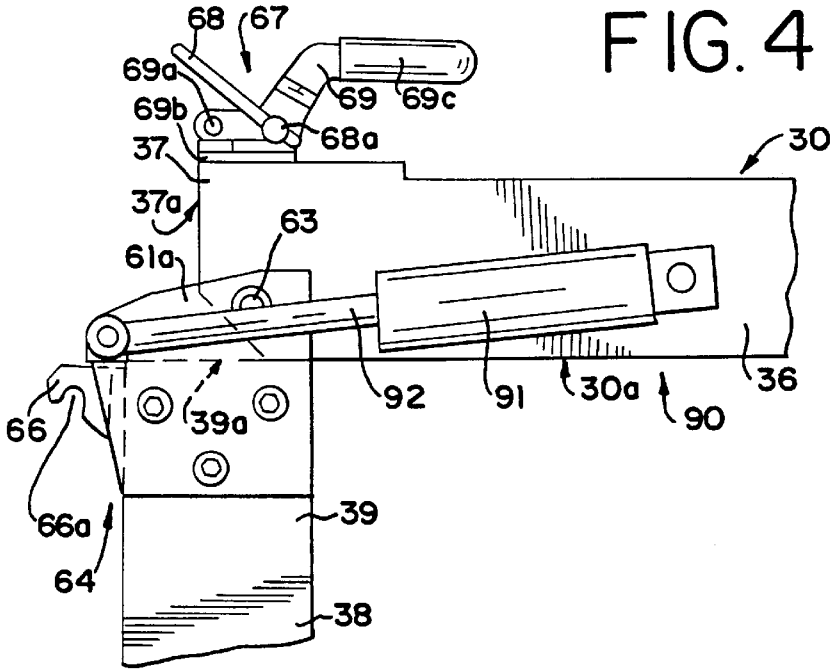
FIG. 4 is a side elevation view of an upper arm and hinge assembly in the second folded position.

Turning to FIGS. 2–4, the specifics of the hinge assembly 35 for the upper arms 30 are shown. Each arm 30 has a first arm section 36 connected to the base section 11 and a second arm section 38 supporting the printing head 31 or curing unit. This first arm section 36 has a first mating portion 37 terminating at a leading edge 37*a* and the second arm section 38 has a second mating portion 39 terminating at a leading edge 39*a*. The hinge assembly 35 cooperates with and is carried by these mating portions 37,39. The hinge assembly 35 permits the second mating portion 39 and second arm section 38 to rotate relative to the first mating portion 37 and first arm section 36.

The hinge assembly 35 has two parallel plates 61, rigidly connected by bolts 62 or welding to the second mating portion 39 and a pivoting connection, namely, a pivoting pin 63 to the first mating portion 37. The plates 61 are positioned adjacent and abutting opposed sides of the two mating portions 37,39 and extend inwardly beyond the leading edge 39*a* of the second mating portion 39. The pivot pin 63 passes through the two plates 61 via aligned apertures therein (not shown) and transversely through the first mating portion 37. The second arm section 38 and second mating portion 39 rotate about this pivot pin 63 relative to the first arm section 36 and first mating portion 37. Accordingly, in the first position, the first and second mating portions are aligned (FIGS. 2 and 3) and in the second position, the first and second mating portions are angular to one another (FIG. 4).

A latch mechanism 67 is secured to the first mating portion 37 for cooperating with a hook assembly 64 secured to the second mating portion 39. In the extended first position, the latch mechanism 67 is locked to the hook assembly 64 and in the folded second position, the latch is separated from the hook.

The hook assembly 64 includes a base 65 secured to the second mating portion 39 adjacent the leading edge 39*a*. An integral hook 66 with an opening 66*a* directed (or open) away from the base section 11 and latch 67 is integral with the base section 65.

The latch mechanism 67 has a ring 68 pivotally connected by a pin 68*a* to a Z-shaped lever 69. The Z-shaped lever 69 is also pivotally attached by a pin 69*a* to a base 69*b* connected to the first mating portion 37. A grip 69*c* is formed around the distal end of the lever 69.

The lever 69 can be rotated (lifted and lowered)(see arrow A in FIG. 2) about its pin 69*a* for engaging, disengaging and locking the attached ring 68 to the hook 66. In short, the lever 69 of FIG. 2 can be lifted to disengage the ring 68 from the hook 66 (FIG. 3) and lowered as in FIG. 2 to engage and lock the latch mechanism 67 to the hook assembly 64.

The second arm section 38, when in the second, folded position, is substantially perpendicular to the first arm section 36 (FIG. 4). In this second position, the leading edge 39*a* of the second arm section 38/second mating portion 39 is positioned below the lower surface 30*a* of the first arm section 36/first mating portion 37.

Each plate 61 has an upper flange 61*a* for supporting a cylinder assembly 90. This air cylinder assembly 90 assists in the lowering and raising of the second arm section 38 (which can be quite heavy), and in biasing the second arm section 38 in either the locked (first, extended) position (FIG. 2) or the folded (second) position (FIG. 4). The assembly 90 dampens the rotation rate and impact of the printing head 31 and unlocked second arm section 38, making maneuvering easier and safer. In addition, the assembly makes lifting and holding the second arm section 38 in position for locking and unlocking also easier and safer. Each cylinder assembly 90 comprises a chamber 91, a piston rod 92 moveable relative to chamber and means for rotatably connecting the assembly to the flange 61*a* and first arm section 36. In the preferred embodiment, each piston has an air (or fluid) line (not shown) in communication with the chamber 91, a first bearing 93 integral with the rod 92 connected to a post 93*a* on the flange 81 and a second bearing 94 adjacent the chamber 91 connected to a post 94*a* on the first arm section 36.

It should be noted the first mating portion 37 has a cut-out 37*a* and edge 37*b* adjacent the bottom surface 30*a* to accommodate the rotation of the leading edge 39*a* of the second mating portion 39 and the second arm section 38.

The weight due to gravity of the printing head 31 (or curing unit, if not disconnected before folding) and the second arm section 38, in combination with the biasing by the cylinder 90, ensure the second arm section and equipment are maintained in the folded, second position (FIG. 4) during storage and/or transportation. In addition, the lower surface 30*a* of the first arm section 36 acts as a bumper or stop for the leading edge 39*a* of the second arm portion 39 preventing further movement of the second arm section 38 toward the first arm section 36 and base section 11.

The above components permit the arm sections to be 1) locked in the first, extended position wherein the arm sections are aligned, 2) unlocked, rotated to the second, folded position wherein the arm sections are angular to one another, and 3) maintained in the second position.

The Lower Arms 70

First Embodiment

Figure 6:
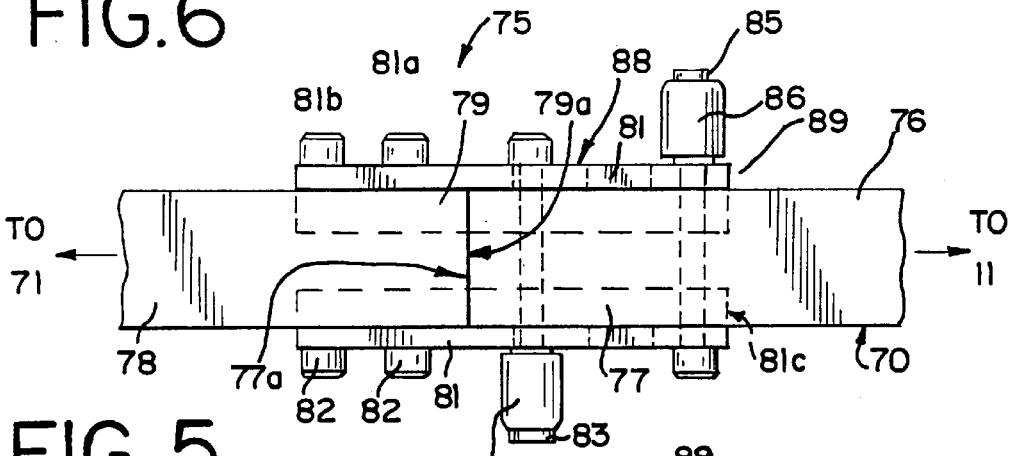
FIG. 6 is a top plan view of the lower arm and hinge assembly of FIG. 5.
Figure 5:
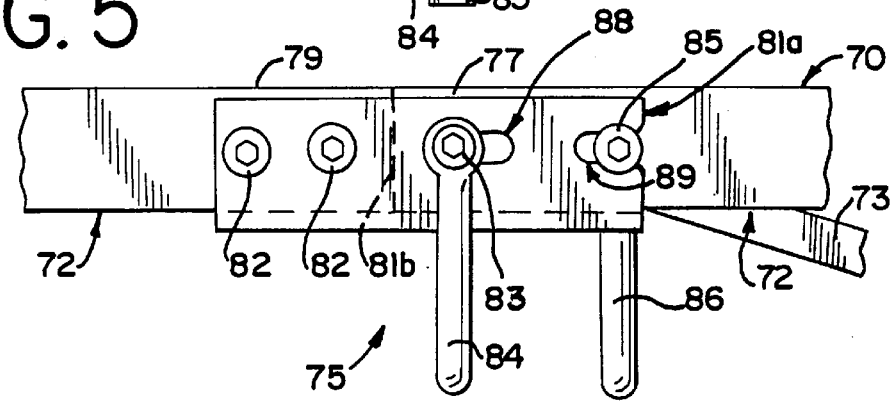
FIG. 5 is a side elevation view of a lower arm and hinge assembly of the first embodiment in the first extended position.
Figure 7:
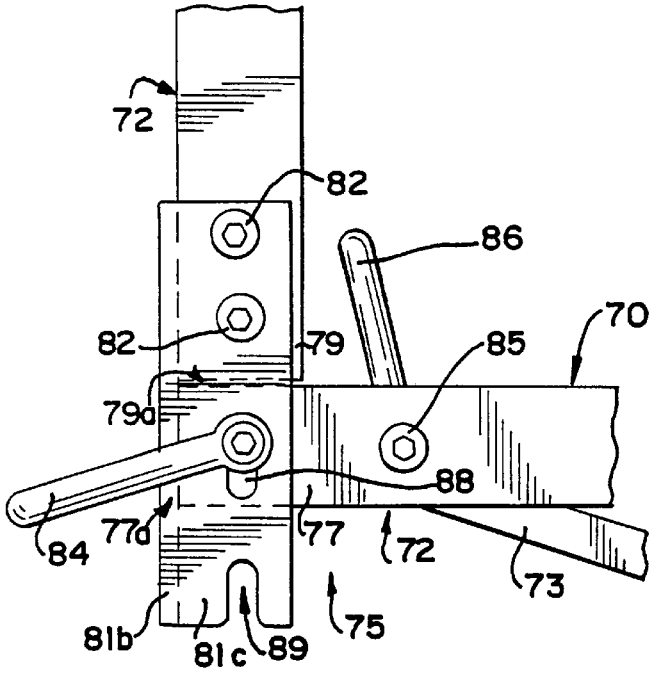
FIG. 7 is a side elevation view of an lower arm and hinge assembly of the first embodiment in the second folded position.

Turning to FIGS. 5–7, the specifics of the hinge assembly of the first embodiment 75 are shown for the lower arms 70. In particular, each arm 70 has a brace 73 adding structural support to the arm, a first arm section 76 connected to the base section 11, and a second arm section 78 supporting the pallet 71. This first arm section 76 has a first mating portion 77 terminating at a leading edge 77*a*, and the second arm section 78 has a second mating portion 79 terminating at a leading edge 79*a*. The mating portions 77,79 carry the hinge assembly 75 for permitting the second mating portion 79 and second arm section 78 to rotate relative to the first mating portion 77 and first arm section 76. This hinge assembly 75 further includes means for locking the arm 70 in either the extended (first) position or in the folded (second) position. In this embodiment, the hinge assembly 75 is positioned on the arm 70 beyond the brace 73, away from the base section 11.

The hinge assembly 75 has two parallel plates 81 rigidly connected by tightened, aligned bolts 82, or welding, to the second mating portion 79 and a pivoting connection, namely, a first securing bolt 83 to the first mating portion 77. The plates 81 are positioned adjacent and abutting opposed sides of the two mating portions 77,79 and extend inwardly, beyond the leading edge 79*a* of the second mating portion 79. The plates 81 are also L-shaped in cross section (FIG. 6), having a side portion 81*a* and base portion 81*b*, so as to have the bottom portion 81*b* abut the bottom surfaces 72 of the arm sections 76,78 and mating portions 77,79. Each plate 81 further includes a slot 88 and a cut-out 89 in series with one another. The slots 88 of each plate 81 are further aligned (parallel one another) and the cut-outs 89 of each plate 81 are aligned (parallel one another).

The first securing bolt 83 passes through the two plates 81 via the aligned slots 88 and transversely through the first mating portion 77 and includes a handle 84 at one end and a nut at the other end. As a result (assuming the second securing bolt 85 is unlocked (discussed below)), one can tighten or loosen the connection between the plates 81 and the mating portion 77 by gripping and rotating the handle. When the first securing bolt 83 is loosened, the second mating portion 79 and second arm section 78 are free to rotate about the first mating portion 77 and first arm section 76. Contrarily, when the first securing bolt 83 is tightened, the second mating portion 79 and second arm section 78 are locked to the first mating portion 77 and first arm section 76.

The second arm section 78 and second mating portion 79 thus rotate about the first securing bolt 83 relative to the first arm section 76 and first mating portion 77.

Accordingly, in the first position, the first and second mating portions are aligned (FIGS. 5 and 6) and, in the second position, the first and second mating portions are angular to one another (FIG. 7).

Similarly, a second securing bolt 85 works with the first securing bolt 83 and passes through the two plates 81 via the aligned cut-outs 89 and transversely through the first mating portion 77 and includes a handle 86 at one end and a nut at the other end. As a result, one can tighten or loosen the connection between the plates 81 and the mating portion 77 by gripping and rotating the handle 86. When the second securing bolt 85 is loosened, the second arm section 78 is able to move/slide relative to the first arm section 76. Contrarily, when the second securing bolt 85 is tightened, the second mating portion 79 and second arm section 78 are locked to the first mating portion 77 and first arm section 76.

The bottom portions 81*b* of the plates 81 act as bumpers or stops to the bottom 72 of the first mating portion 77 and arm section 76.

FIGS. 5 and 6 show the lower arm 70 in the extended, first position and FIG. 7 shows the arm 70 in the folded, second position. In the first position, the mating portions 77,79 are aligned with each's leading edge 77*a*,79*a* abutting one another. The bottom surface 72 of the first mating portion 77 rests on and abuts the bases 81*b* of the plates 81 and the securing bolts 83,85 are tightened. To move the second arm section 78 to the folded position, both securing bolts 83,85 are loosened by turning the handles 84,86. The second arm section 78 and second mating portion 79 are next pulled outwardly, away from the first arm section 76, first mating portion 78, and base section 11 a distance approximately the length of the slot 88. The first securing bolt 83 originally positioned at one end of the slot 88 is slid to a position at the other end of the slot. Simultaneously, the second securing bolt 85 clears the cut-out 89 and the end of the plate 81*c*. The second arm section 78 is then rotated to a position substantially perpendicular to the first arm section 76. The weight of the second arm section 78 causes the section to drop and the first securing bolt 83 to slide from its position at the other end of the slot 88 to its original position in the slot (FIG. 7). The first securing bolt 83 is next turned by the handle 84 to lock the second arm section 78 in the perpendicular position relative to the first arm section 76.

In this second position, the leading edge 79*a* of the second arm section 78/second mating portion 79 is positioned above the upper surface of the first arm section 76/first mating portion 77 with the upper surface of the first arm section acting as a bumper or stop to any further movement (rotational progress) of the second arm section.

While the above descriptions identify the locking mechanisms as securing bolts, it is recognized by those skilled in the art other conventional mechanisms may be employed, such as cams, set screws, keys, etc.

The Lower Arms 170

Second Embodiment

Figure 8:
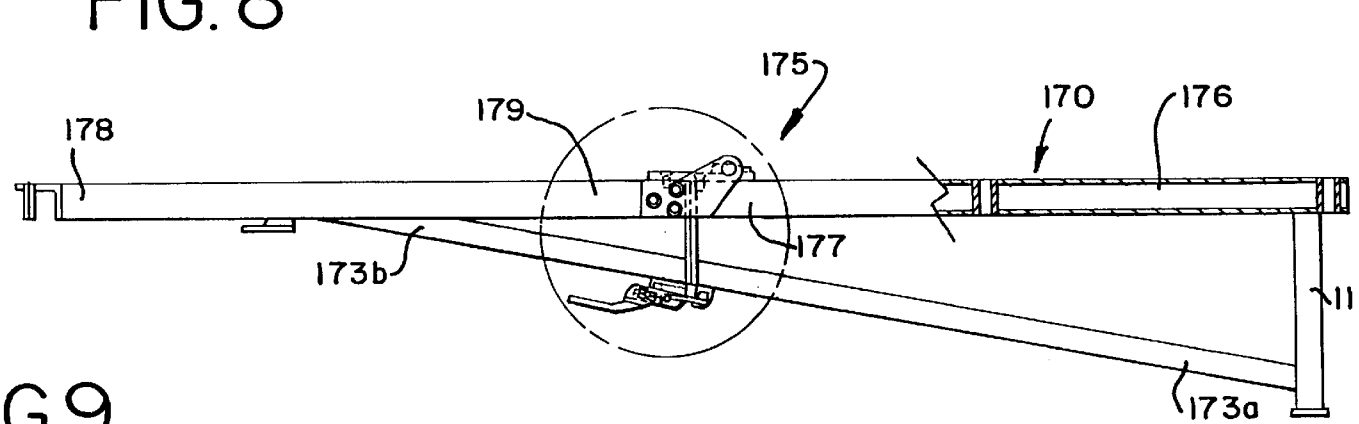
FIG. 8 is a side elevation view of a lower arm and hinge assembly of the second embodiment in the first extended position.
Figure 9:
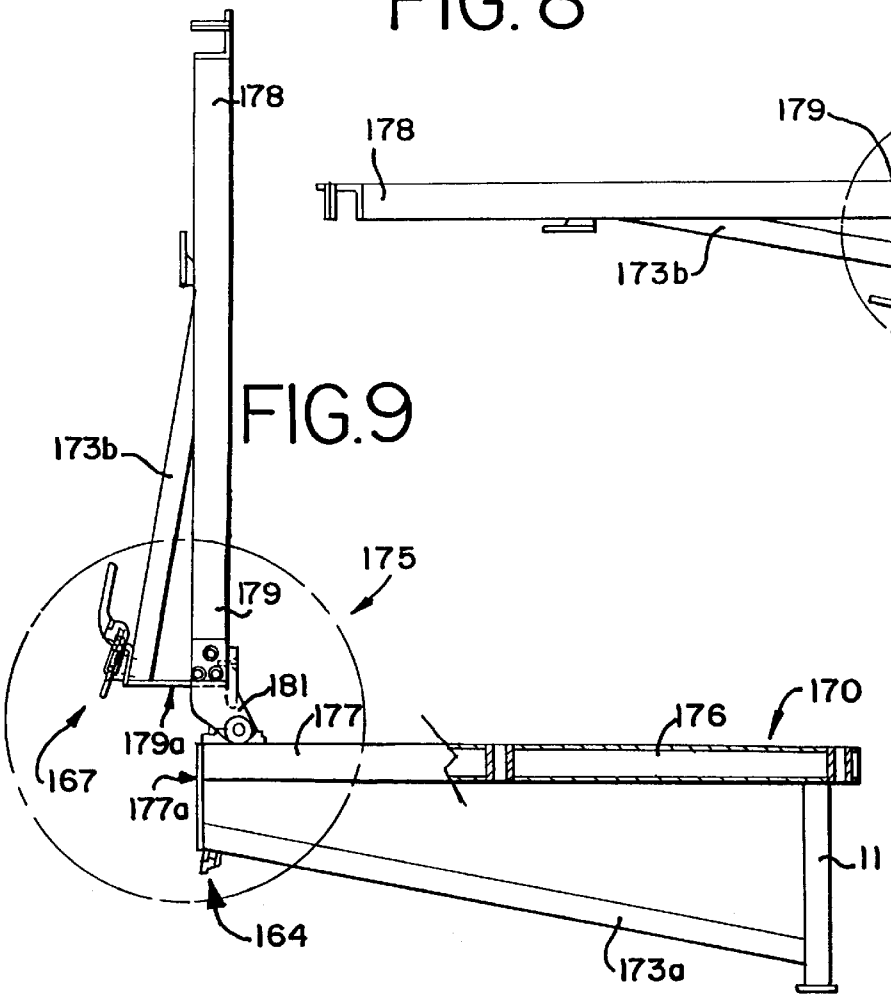
FIG. 9 is a side elevation view of a lower arm and hinge assembly of the second embodiment in the second folded position.
Figure 10:
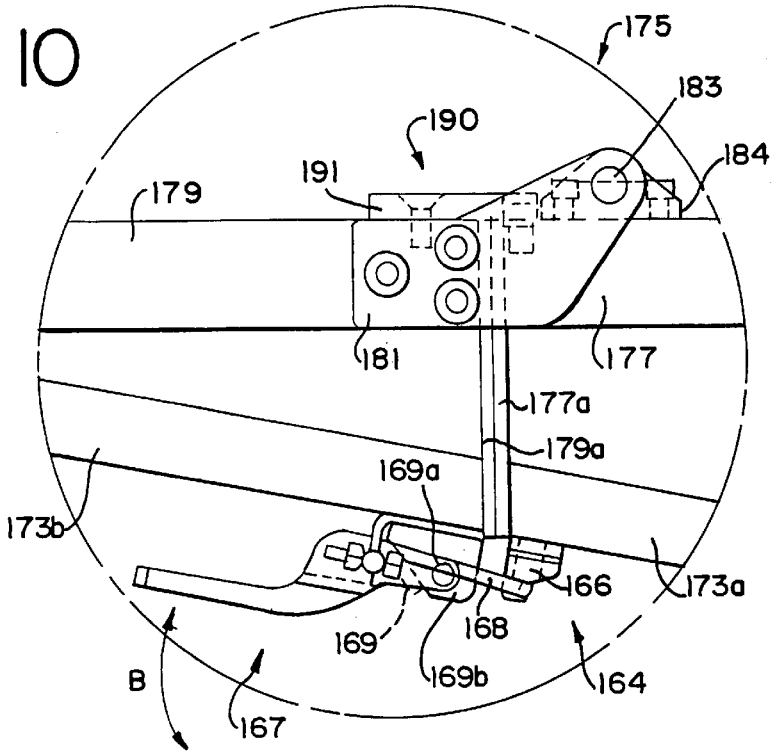
FIG. 10 is a detailed side elevation view of the circled portion in FIG. 8.
Figure 11:
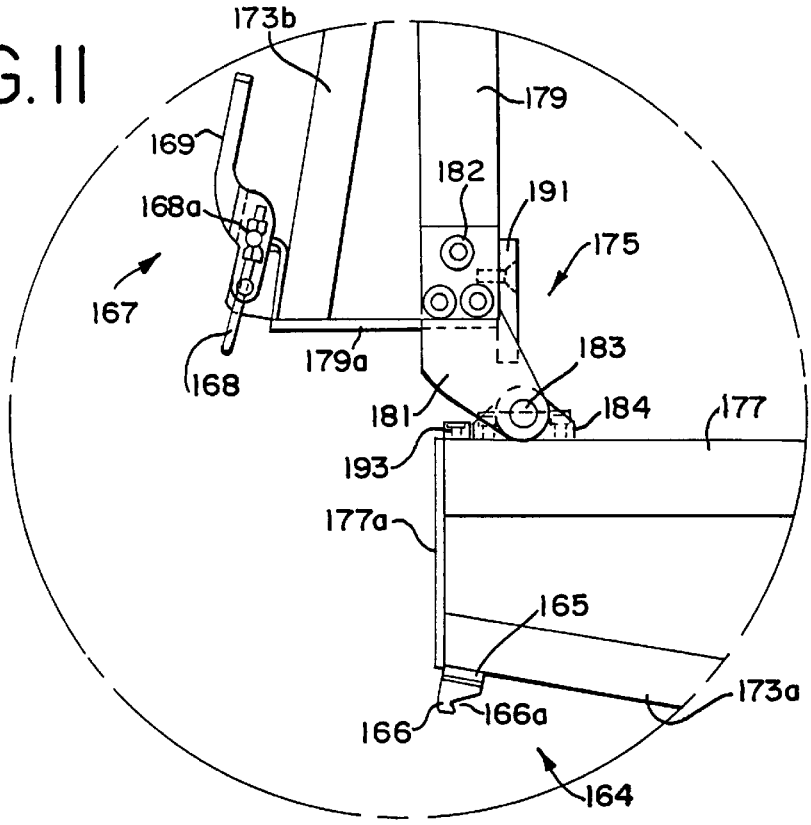
FIG. 11 is a detailed side elevation view of the circled portion in FIG. 9.

Turning to FIGS. 8–19, the specifics of the hinge assembly of the second embodiment 175 are shown for the lower arms 170. For clarity, each component of this embodiment will be assigned a 100 series reference numbers. The arm 170 is shown in the first, extended position (FIGS. 8, 10, 12 and 13) and the second, folded position (FIGS. 9 and 11). Each arm 170 has a brace 173*a*,173*b* adding structural support to the arm, a first arm section 176 connected to the base section 11, and a second arm section 178 supporting the pallet (not shown). The brace 173*a*, 173*b* of this embodiment comprises two portions and is welded at one end to the base section 11, and at the other end, proximate the distal end. This first arm section 176 has a first mating portion 177 terminating at a leading edge 177*a* (in the form of a plate welded to the free end of the portion 177 and brace 173*a*) and the second arm section 178 has a second mating portion 179 terminating at a leading edge 179*a* (also in the form of a plate welded to the free end of the portion 179 and brace 173*b*). The hinge assembly 175 cooperates with and is carried by these mating portions 177,179 in combination with the brace 173*a*,179*a*. The hinge assembly 175 permits the second mating portion 179 and second arm section 178 to rotate relative to the first mating portion 177 and first arm section 176.

This hinge assembly 175 further includes means for locking the arm 170 in the extended (first) position and maintaining the arm in the second, folded position.

The hinge assembly 175 has two parallel, elbow plates 181, each rigidly connected by tightened bolts 182 or welding to the second mating portion 179 and by a pivoting connection, namely, a pivoting pin 183, to the first mating portion 177. The elbow plates 181 (See FIGS. 14 and 15 (the other plate being a mirror image thereof)) are positioned adjacent and abutting opposed sides of the two mating portions 177,179 and extend inwardly beyond the leading edge 179*a* of the second mating portion 179. The pivot pin 183 passes through the two plates 181 via aligned apertures 181*a* therein and transversely through an opening 184*a* in a block 184 welded or bolted to the top surface of the first mating portion 177. The second arm section 178 and second mating portion 179 rotate about this pivot pin 183 relative to the first arm section 176 and first mating portion 177. Accordingly, in the first position, the first and second mating portions are aligned (FIGS. 8, 10, 12 and 13) and in the second position, the first and second mating portions are angular to one another (FIGS. 9 and 11).

A latch mechanism 167 is secured to the second brace portion 173*b* for cooperating with a hook assembly 164 secured to the first brace portion 173*a*. In the extended first position, the latch mechanism 167 is locked to the hook assembly 164, and in the folded second position, the latch is separated from the hook.

The hook assembly 164 includes a base 165 secured to the first brace portion 173*a* adjacent the leading edge plate 177*a*. An integral hook 166 with an opening 166*a* directed (or open) toward the base section 11 and away from the latch 167 is integral with the base 165.

The latch mechanism 167 has a ring 168 pivotally connected by a pin 168*a* to a Z-shaped lever 169. The Z-shaped lever 169 is also pivotally attached by a pin 169*a* to a base 169*b* connected to the second brace portion 173*b*. A grip is formed around the distal end of the lever 169.

The lever 169 can be rotated (lifted and lowered)(see arrow B in FIG. 10) about its pin 169*a* for engaging, disengaging and locking the attached ring 168 to the hook 166. In short, the lever 169 can be lifted to disengage the ring 168 from the hook 166 (FIG. 11) and lowered as in FIG. 10 to engage and lock the latch mechanism 167 to the hook assembly 164.

The second arm section 178, when in the second, folded position, is substantially perpendicular to the first arm section 176 (FIGS. 9 and 11) or acute to the first arm section (not shown). For example, while not shown, the second arm section may be further rotated to rest either on the first arm section or base section. It does, nevertheless, hold and maintain its folded position. In this second position, the leading edge/plate 179*a* of the second arm section 178/second mating portion 179 is positioned above the top surface of the first arm section 176/first mating portion 177.

The above components permit the arm sections to be 1) locked in the first, extended position wherein the arm sections are aligned, 2) unlocked, rotated to the second, folded position wherein the arm sections are angular to one another, and 3) maintained in the second position.

Figure 12:
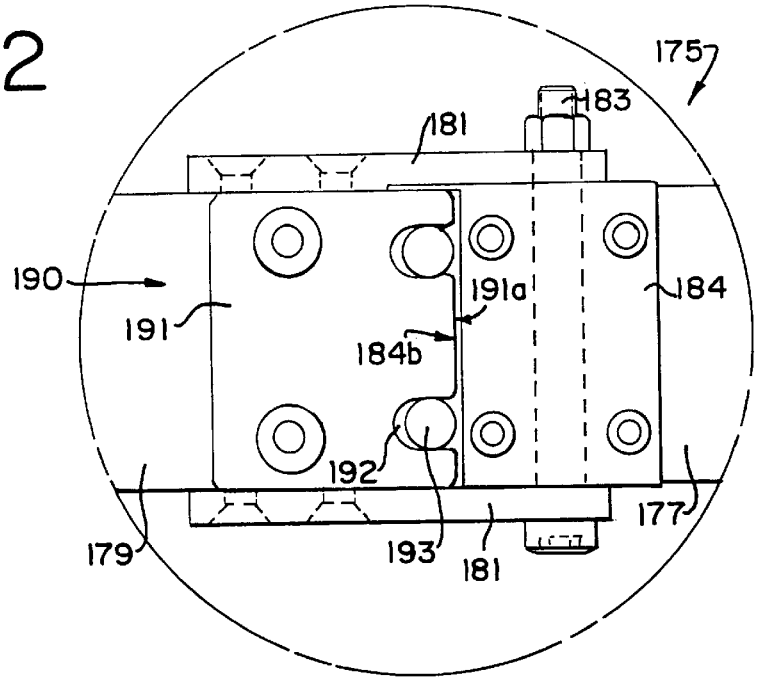
FIG. 12 is a top plan view of the lower arm and hinge assembly of FIG. 8.
Figure 13:
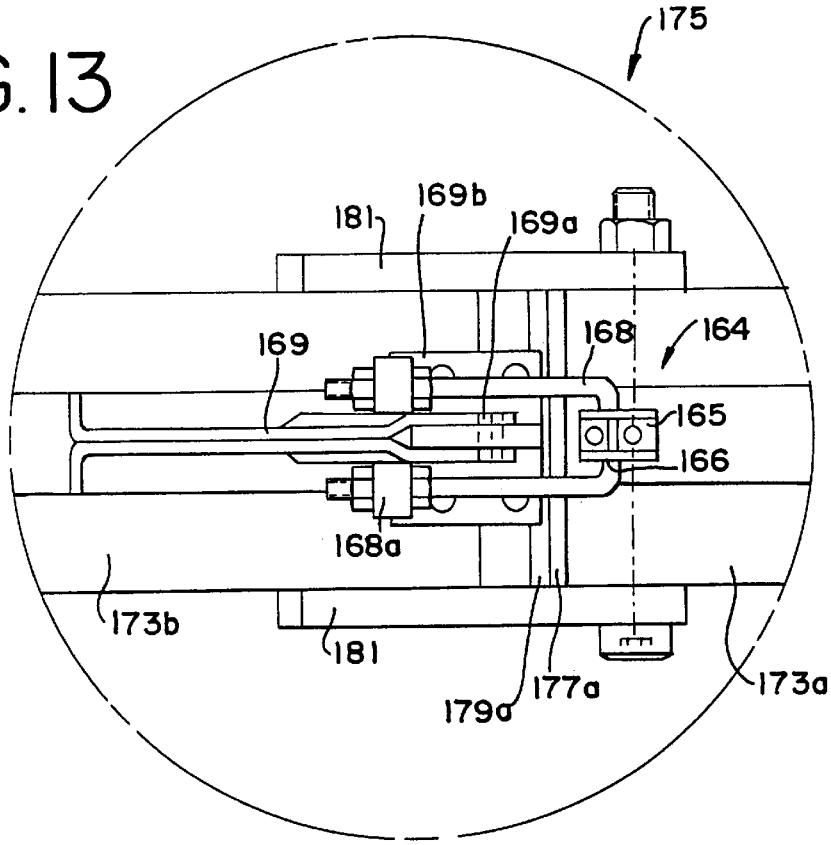
FIG. 13 is a bottom plan view of the lower arm and hinge assembly of FIG. 8.
Figure 15:
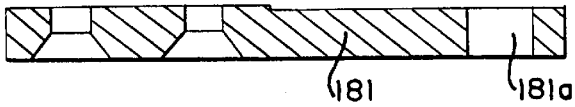
FIG. 15 is a sectional view along line 15—15 in FIG. 14.
Figure 14:
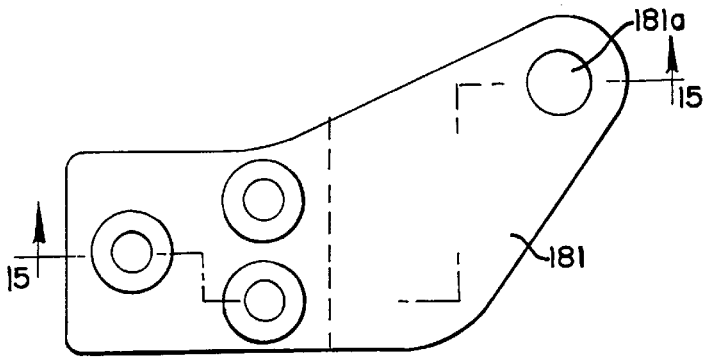
FIG. 14 is a side elevation view of a plate of the second embodiment of the lower arm.
Figure 16:
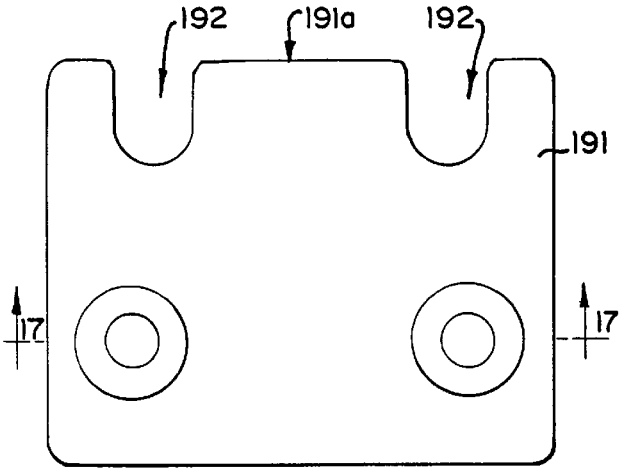
FIG. 16 is a top plan view of a registration plate.
Figure 18:
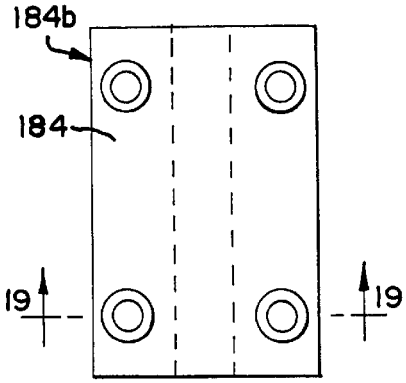
FIG. 18 is a top plan view of a block.
Figure 17:
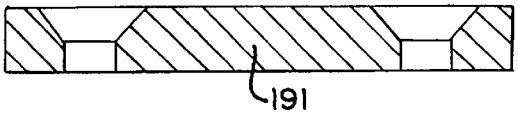
FIG. 17 is a sectional view along line 17—17 in FIG. 16.
Figure 19:
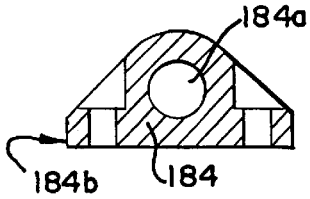
FIG. 19 is a sectional view along line 19—19 in FIG. 18.

FIGS. 12, 16 and 19 show the details of a registration assembly 190 to ensure proper alignment and registration each time the arm's 170 sections 176,179 are latched and locked in the first extended position (FIG. 8). The registration system 190 incorporates a registration plate 191 bolted or welded to the top surface of the second mating portion 179. This plate has a pair of arcuate indents 192 therein mounted to face the first mating portion 177. The plate 191 is mounted so as to have the leading edge 191 of the plate and indents 192 project beyond the leading edge/plate 179*a* of the second arm section 178/mating portion 179. A pair of parallel posts 193 are mounted to the top surface of the first mating portion 177. These posts 193 are mounted adjacent the leading edge/plate 177*a* of the first arm section 176/mating portion 177.

As a result, when the arm 170 is unfolded to the extended position and as shown in FIG. 12, the parallel posts 193 engage and couple with the arcuate indents 192 in the registration plate 191, while the leading edges of the two mating portions 177*a*, 179*a* contact one another for accurate alignment and registration of the two arm sections 176,178 relative to one another.

This registration system can be adapted for use on the first embodiment of the lower spider arm assembly and on the upper spider arm assembly discussed in detail above.

Specifically, as to longitudinal registration (registration in the direction of the arm), two "contact" pieces can be used to contact and cooperate with one another. For the upper arm, the leading edges of the mating portions (37*a*,39*a*) or leading edge of the base (65) associated with the hook (66) and the leading edge of the base (69*b*) associated with the latch (67) can be used. These leading edges can be flat or contoured for specific mating. As to the lower arm of the first embodiment, the leading edges (77*a*,79*a*) of the mating portions (77,79) can be used. For transverse registration (registration in the cross direction of the arm), one or more posts (like post 193) are first connected to the top or bottom surface of the arm adjacent the mating portion's leading edge. Next, an element is extended beyond the other mating portion's leading edge with an indent therein for receiving and capturing the post when the arm is in the extended position. For example, with respect to the upper arm 30, a post is connected to the upper surface of the second mating portion 39 adjacent the leading edge 39*a* in front of the hook 66. An indent is cut in the base 69*b* of the latch, which extends beyond the leading edge 37*a* of the first mating portion 37. Thus, registration occurs when the two mating portion edges 37*a*,39*a* contact and the post is captured by the indent.

The Truck 300

Figure 22:
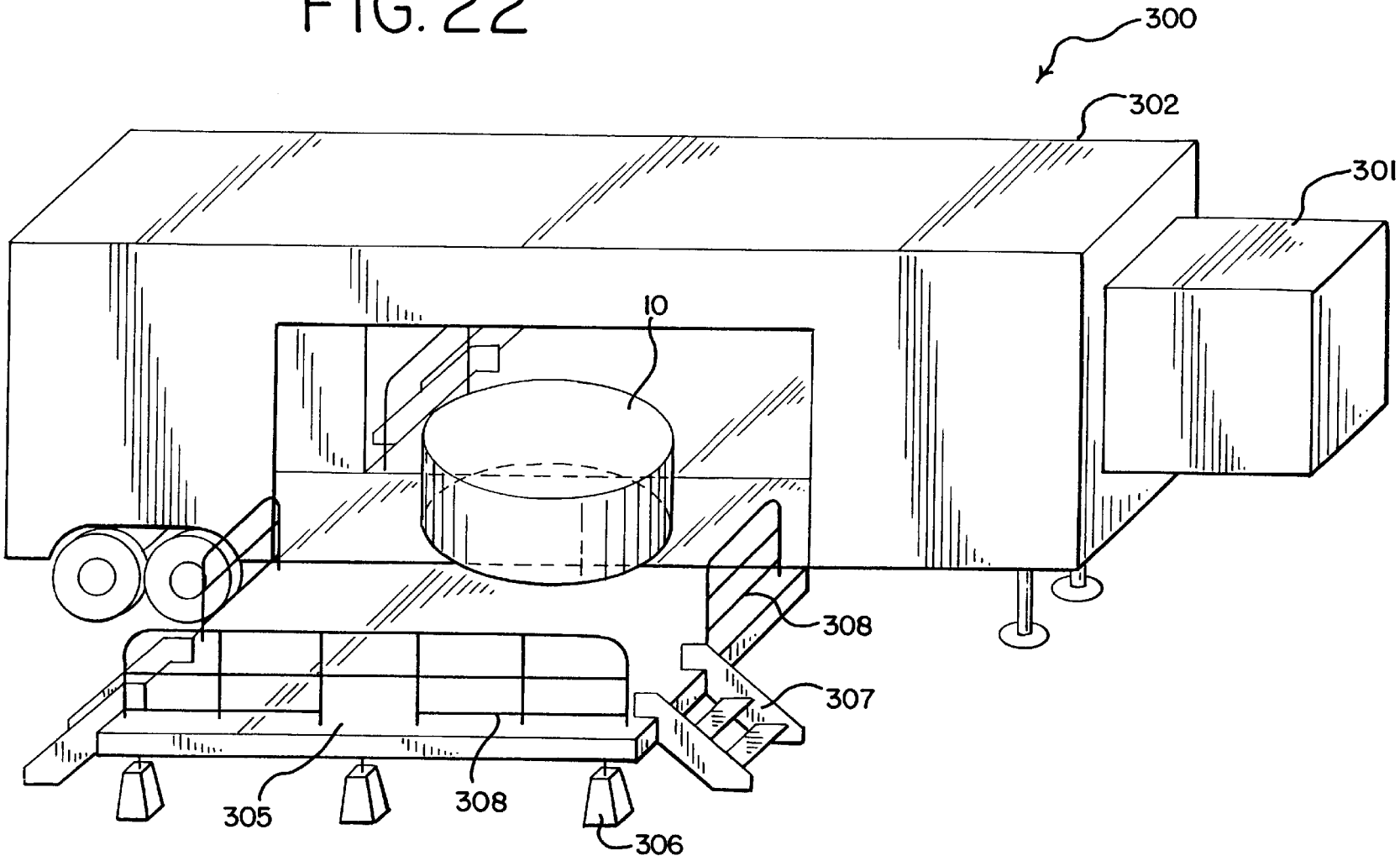
FIG. 22 is a perspective view of the truck, in the open position, with the printing machine being shown schematically and in the extended, operational position.
Figure 23:
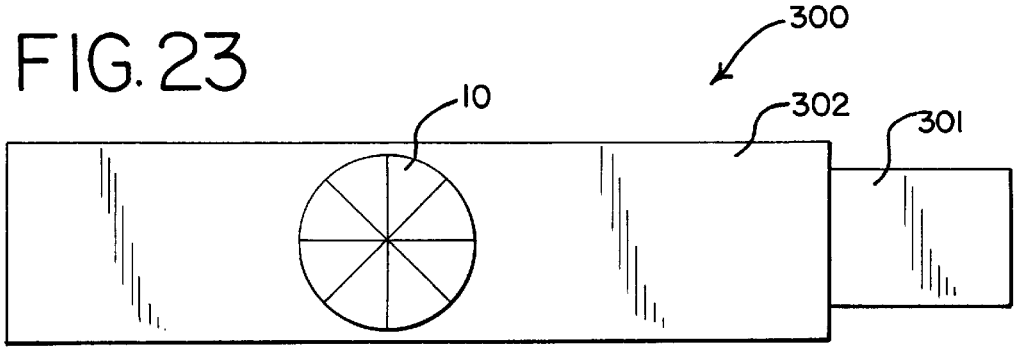
FIG. 23 is a schematic top plan view of the truck and printing machine in the folded, storing/transporting position.
Figure 24:
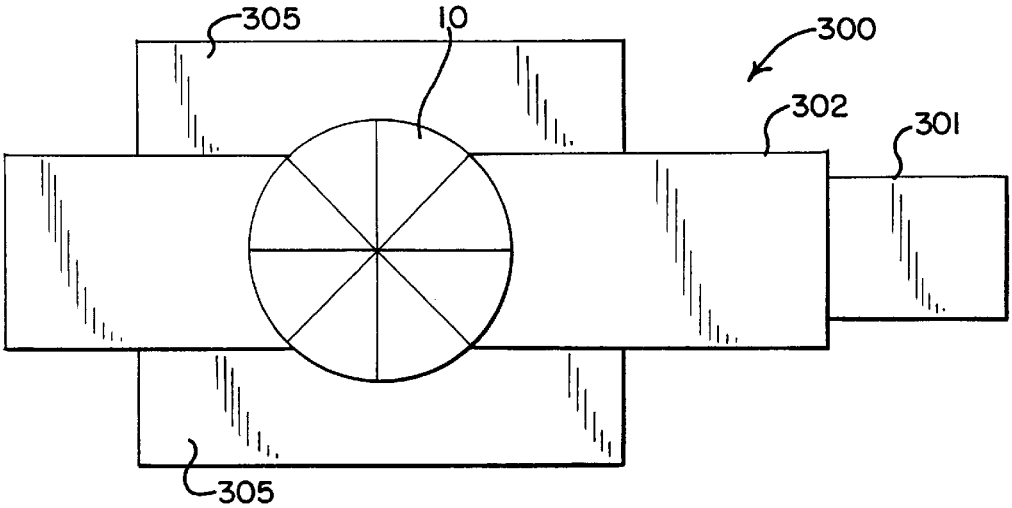
FIG. 24 is a schematic top plan view of the truck and printing machine in the extended, operational position; and, FIG. 25 is a schematic top plan view of the truck.
Figure 25:
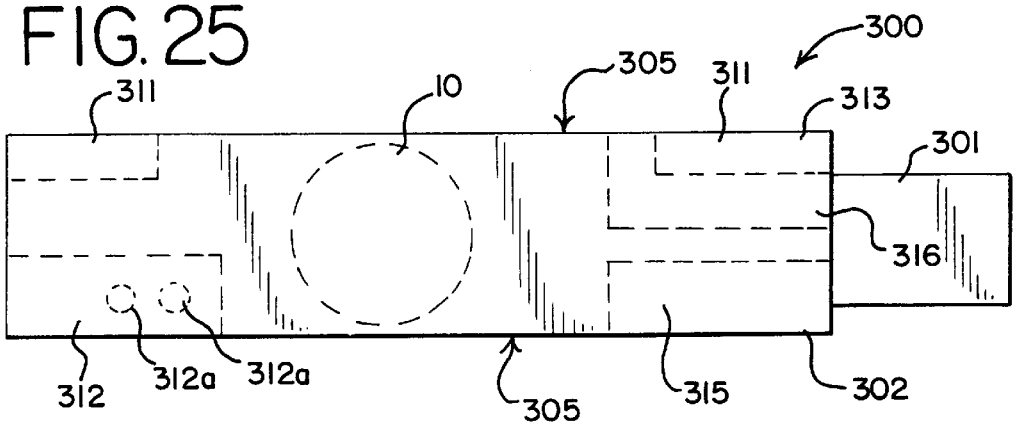

FIGS. 22–25 show a truck incorporating the above printing machine. In particular, the truck 300 is a portable screen printing shop. It is designed to include all hardware necessary to make screens, print textiles with those screens and dry the printed textiles. As shown in the Figures, the truck has a cab 301 for drivers and a trailer 302 for the cargo. The turret style printing machine discussed in detail above is housed in this truck 300. While the machine is assembled, it is nevertheless folded for transporting and storage (FIGS. 23 and 25). For operation, the arms are extended (FIGS. 22 and 24). The arms are locked during transportation to prevent them from bouncing and moving during the journey.

Once the truck is in position at the desired site, the sides 305 of the truck are opened. The opposed side panels 305 are each on hinges permitting them to be pivoted or rotated downwardly so as to open up the sides of the trucks 302 and create side platforms. Here, platform stands 306 are positioned below the opened side panel or platform for additional support and stability. Stepladder ramps 307 are attached to the ends of the platform and railings 308 installed. This permits individuals, either workers or spectators, to easily enter/exit the truck or file past the machinery, respectively. This also permits the machine's operators and anyone else working equipment on the truck to walk/work freely, with ample space, around the machine 10. The surface of the platforms 305 is serrated or grooved or a high friction paint or surfaces is added thereto to minimize slipping by individuals. These side platforms 305, formed of the side panels, naturally increases the vehicle's floor space.

Once the side panels 305 are opened, the turret style machine 10 can be unlocked and unfolded and locked in the extended position (FIGS. 22 and 24).

The truck further houses:

1) means for preparing the printing screens, such as a exposure unit and complete registration system like the one disclosed in the patent application titled SCREEN PRINTING REGISTRATION SYSTEM, filed Oct. 15, 1996, U.S. Ser. No. 08/732,518 (Attorney Docket No. 1199 P 077), and incorporated herein by reference, an exposure unit 315, and processing area 316;

2) means for storing the textiles (shirts, pants, fleece ware, hats, etc.), both printed and to be printed, such as built-in shelves, fold-down table tops and storage chests 311;

3) means for drying the printed upon textiles 312, such as the dryer disclosed in the patent application titled DRYER ASSEMBLY, filed Oct. 15, 1996, U.S. Ser. No. 08/732,516 (Attorney Docket No. 1199 P 078)(incorporated herein by reference) and sold by M&R SALES AND SERVICE, INC. (Glen Ellyn, Ill.) under the trademark VIPER™ or the MAXI-CURE™ Infra-Red Dryer, also sold by M&R;

4) ink for the screens (not shown);

5) means for storing screens 313, either pre-prepared or clean/blank for subsequent preparation and prepared, such as cabinets or racks;

6) a conventional electrical generator for powering the equipment (not shown);

7) water tanks for supplying clean water and water tanks for storing dirty water (not shown); and, 8) venting means 312*a* for exhausting from the dryer and optionally delivering outside air to the dryer.

Each of the above items, shown schematically in FIG. 25, is conventional and well-known in the screen printing industry. Accordingly, depending on the configuration desired within the truck (job shop), each can be located in position in line with one's personal taste.

The above assembly permits one to transport an entire printing shop to an event, like a concert, festival, celebration, convention, sporting event, etc., set-up the printing shop, and print, sell and distribute the printed wares. As a result, items can be printed and sold at the event and even customized. Once completed, one can pack-up the shop and transport the entire printing shop to the next event.

While the specific embodiments have been illustrated and described, numerous modifications are possible without significantly departing from the spirit of the invention, and the scope of protection is only limited by the scope of the accompanying Claims.

We claim:

1. A mobile printing shop comprising:

a turret style printing machine having a plurality of radial arms with all the arms movable between a first, extended position, with the machine having a first overall machine diameter, and a second, folded position, with the machine having a second overall machine diameter, the first overall diameter being greater than the second overall diameter; and, a vehicle for transporting the printing machine, the machine being in the second, folded position during transportation of the machine in the vehicle and the first, extended position during operation of the machine.

2. A mobile printing shop as defined in claim 1 wherein the plurality of radial arms includes a plurality of radial upper arms and a plurality of radial lower arms connected proximate a first end to a base section with either the lower arms moving relative to the upper arms or the upper arms moving relative to the lower arms, the upper arms supporting at a second end one of either a pallet or a printing head and the lower arms supporting at the other end the other of the pallet or the printing head; and, further including means disposed between the ends of the arms for folding each arm by moving the other end of each arm towards the base section.

3. The mobile printing shop as defined in claim 1 wherein the vehicle is a truck and the printing machine is fixed with the truck.

4. The mobile printing shop as defined in claim 3 wherein the vehicle includes two side panels, each side panel opening up to permit the machine to be unfolded to the first overall diameter and operated.

5. The mobile printing shop as defined in claim 4 wherein the vehicle further includes at least one foldable side platform for increasing the vehicle's floor space.

6. The mobile printing shop as defined in claim 4 wherein the vehicle includes two foldable side platforms for increasing the vehicle's floor space.

7. The mobile printing shop as defined in claim 4 wherein the vehicle further includes therein means for preparing the printing screens, means for storing the textiles, and means for drying the printed upon textiles.

8. A mobile printing shop comprising:

a printing machine having an arm thereon connected proximate a first end to a base section and supporting at a second end one of either a pallet or a printing head, the arm being extended when the second end is in a first position for operating the machine;

a hinge assembly disposed between the ends for folding the arm by moving the second end to a second position located generally between the base section and the first position; and, a vehicle for holding and transporting the printing machine, the machine being in the second, folded position during transportation of the machine in the vehicle and the first, extended position during operation of the machine.

9. The mobile printing shop as defined in claim 1 wherein the vehicle is a truck.

10. The mobile printing shop as defined in claim 8 wherein the hinge assembly further includes means for locking the arm in either the extended, first position or the second position, and wherein the arm has a first arm section connected to the base section and a second arm section supporting the printing head or the pallet, the first arm section having a first mating portion and the second arm section having a second mating portion, and the hinge assembly cooperates with the first and second mating portions.

11. The mobile printing shop as defined in claim 9 wherein the vehicle includes two side panels, each side panel opening up to permit the machine to be unfolded and operated.

12. The mobile printing shop as defined in claim 9 wherein the vehicle further includes at least one foldable side platform for increasing the vehicle's floor space.

13. The mobile printing shop as defined in claim 9 wherein the vehicle includes two foldable side platforms for increasing the vehicle's floor space.

14. The mobile printing shop as defined in claim 9 wherein the vehicle further includes therein means for preparing the printing screens, means for storing the textiles, and means for drying the printed upon textiles.

* * * * *